US011105144B2

(12) United States Patent
Schweiss

(10) Patent No.: US 11,105,144 B2
(45) **Date of Patent: *Aug. 31, 2021**

(54) METHOD OF FORMING A FRAME USING A SPLICE ASSEMBLY

(71) Applicant: SORREL QUARTERS, LLC, Hector, MN (US)

(72) Inventor: Michael L. Schweiss, Fairfax, MN (US)

(73) Assignee: SORREL QUARTERS, LLC, Hector, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/665,248

(22) Filed: Oct. 28, 2019

(65) Prior Publication Data

US 2020/0115952 A1 Apr. 16, 2020

Related U.S. Application Data

(62) Division of application No. 15/295,835, filed on Oct. 17, 2016, now Pat. No. 10,669,771, which is a division of application No. 14/751,620, filed on Jun. 26, 2015, now Pat. No. 10,316,576.

(60) Provisional application No. 61/998,361, filed on Jun. 26, 2014.

(51) Int. Cl.

| | |
|---|---|
| ***E06B 3/38*** | (2006.01) |
| ***E05F 15/53*** | (2015.01) |
| ***E05D 3/02*** | (2006.01) |
| ***E05D 5/12*** | (2006.01) |
| ***E05F 15/622*** | (2015.01) |
| ***E06B 3/01*** | (2006.01) |

(Continued)

(52) U.S. Cl.

CPC ..... *E06B 3/38* (2013.01); *E05D 3/02* (2013.01); *E05D 5/12* (2013.01); *E05F 15/51* (2015.01); *E05F 15/53* (2015.01); *E05F 15/622* (2015.01); *E06B 1/12* (2013.01); *E06B 1/522* (2013.01); *E06B 3/01* (2013.01); *E06B 3/483* (2013.01); *E06B 3/968* (2013.01); *E06B 3/9687* (2013.01); *E05D 7/009* (2013.01); *E05Y 2600/45* (2013.01); *E05Y 2900/106* (2013.01); *E05Y 2900/108* (2013.01); *E06B 2003/7044* (2013.01)

(58) Field of Classification Search

CPC ..... F16B 2012/106; F16B 2012/145; F16B 12/14; F16B 12/40; E06B 2003/7044; E06B 3/38; E06B 3/12; E06B 3/06; E06B 3/01; E06B 3/968; E06B 3/964; E06B 3/9687; E05F 15/53; E05Y 2009/106; E05Y 2009/108

See application file for complete search history.

(56) References Cited

U.S. PATENT DOCUMENTS 4,739,600 A * 4/1988 Lynch ..... E06B 3/9647 403/382

5,205,102 A * 4/1993 Plummer ..... E06B 3/9687 52/656.9

(Continued)

*Primary Examiner* — Gregory J Strimbu

(74) *Attorney, Agent, or Firm* — R. John Bartz

(57) ABSTRACT

A frame assembly supporting an overhead door has a horizontal header connected to upright columns or posts with splice assemblies. Fasteners mounted on the columns cooperate with retainers on the splice assemblies to position and connect the columns to the header. Hinge assemblies pivotally mount the door on the header for movement between open and closed positions.

3 Claims, 9 Drawing Sheets

(51) Int. Cl.

| | |
|---|---|
| ***E05F 15/51*** | (2015.01) |
| ***E06B 1/12*** | (2006.01) |
| ***E06B 1/52*** | (2006.01) |
| ***E06B 3/48*** | (2006.01) |
| ***E06B 3/968*** | (2006.01) |
| *E05D 7/00* | (2006.01) |
| *E06B 3/70* | (2006.01) |

(56) References Cited

U.S. PATENT DOCUMENTS

| | | | | |
|---|---|---|---|---|
| 6,883,273 | B2 * | 4/2005 | Kerkvliet | E05D 11/00 49/199 |
| 6,938,380 | B2 * | 9/2005 | Friedman | B66B 13/301 49/505 |
| 7,841,138 | B1 * | 11/2010 | Frey | E06B 3/9642 52/204.5 |
| 10,316,576 | B2 * | 6/2019 | Schweiss | E05D 3/02 |
| 10,358,860 | B2 * | 7/2019 | Schweiss | E06B 1/522 |
| 10,604,991 | B2 * | 3/2020 | Schweiss | E05F 15/622 |
| 10,669,771 | B2 * | 6/2020 | Schweiss | E05F 15/622 |
| 2010/0058668 | A1 * | 3/2010 | Keller | E05D 15/401 49/197 |
| 2011/0225895 | A1 * | 9/2011 | Peterson | E06B 7/22 49/506 |
| 2014/0318049 | A1 * | 10/2014 | Paquet | E06B 3/64 52/204.593 |
| 2015/0208798 | A1 * | 7/2015 | Glenn, II | F16B 12/40 108/158.11 |

* cited by examiner

METHOD OF FORMING A FRAME USING A SPLICE ASSEMBLY

CROSS REFERENCE TO RELATED APPLICATION

This application is a division of U.S. application Ser. No. 15/295,835 filed Oct. 17, 2016, now U.S. Pat. No. 10,669,771. Application Ser. No. 15/295,835 is a division of U.S. application Ser. No. 14/751,620 filed Jun. 26, 2015, now U.S. Pat. No. 10,316,576. Application Ser. No. 14/751,620 has the priority benefit of U.S. Provisional Patent Application Ser. No. 61/998,361 filed Jun. 26, 2014.

FIELD OF INVENTION

The overhead door and frame assembly is in the art of a door for a structure having a doorway that is selectively opened and closed with a door mounted on a frame assembly. The door is a one-piece door mounted with hinges to a header of the frame assembly. Hydraulic cylinders operate to swing the door between an upright closed position to a generally horizontal open position allowing vehicles and equipment to be moved through the doorway into and out of the structure.

BACKGROUND OF THE INVENTION

Buildings have large openings or doorways for accommodating trucks, tractors, airplanes and equipment to be moved into and out of the interior spaces in the buildings. Common types of conventional doors used to open and close the doorways are horizontally sliding doors and two-piece center hinged doors known as bi-fold doors. An example of a bi-fold door is disclosed by M. L. Schweiss in U.S. Pat. No. 6,866,080. A plurality of hinges pivotally mount the bi-fold door to the header of the building whereby the entire weight of the bi-fold door is accommodated by the header of the building. These doors require a larger opening than is required to accommodate the open door. The overall vertical height of the doorway is compromised to compensate for the folded bi-fold door. Overhead doors are used to open and close doorways to maximize the useable space of the doorway of the structures. An example of a hydraulically operated overhead door is disclosed by D. J. Kerkvliet in U.S. Pat. No. 6,883,273. The overhead doors are mounted with hinges on load bearing frames that are separate from the building structures whereby the weight or load of the overhead doors is not subjected to the building headers or side jambs. The load bearing frames are known as free standing headers having a header and upright legs. The legs are field welded on opposite ends of the header. The legs must be straight, flush and flat with the header to maintain the overhead doors in open and closed positions. Welding fixtures and tooling are used to maintain the alignment of the legs relative to the header during the field welding operation. The welding of the legs to the header requires welding skills, supplies, labor and time. R. Peterson in U.S. Patent Application Publication No. 2011/0225895 discloses a door hinged to a frame secured to a building structure and a method of assembly of a door on a plurality of cross members. The frame has a header connected to the upright posts. Connectors join the posts to the header. Fasteners such as bolts secure the connectors to the posts. Hinges pivotally connect the door to the header of the frame. Welds are also disclosed as securing the fasteners to the upright posts.

SUMMARY OF THE INVENTION

The invention is a frame assembly for supporting an overhead door operable to move between a generally upright closed position and a generally horizontal open position. The invention includes a method of connecting a header to the frame assembly. The frame assembly has a horizontal header supported by upright columns. Splice assemblies connect the columns to opposite ends of the header. The splice assemblies include cooperating retainers and fasteners that align the columns with the header and maintain the columns straight, flush and in the same upright plane of the header. A plurality of hinge assemblies pivotally connect a top member of the door frame to the header. Linear actuators such as hydraulic cylinders or motor driven screws connected to the door and columns operate to swing the door between an upright closed position and a generally horizontal open position. The frame assembly supports the weight of the door and absorbs the forces subjected to the door during the opening and closing of the door thereby eliminating most if not all weight and forces on the adjacent building structure. Each splice assembly has an upright body having a wall and opposite end edges. A plurality of upright ribs attached to the body are retained in a flat surface engagement with a column by adjustable fasteners connecting the column to the body. The fasteners include nuts secured to the body and bolts mounted on the column engageable with the nuts. In use, the bolts are turned to move the column into alignment with the header and secure the column to the splice assembly. A plurality of second adjustable fasteners comprise cooperating nuts and bolts. The bolts engage an edge of the body to hold the opposite edge of the body in engagement with the column concurrently with the engagement of the ribs with this column. The first and second adjustable fasteners retain the splice assembly in engagement with the perpendicular walls of the column. The hinge assemblies have sleeves rotatably mounted on non-rotatable pins. Door members secured to the sleeves are connected to the top member of a door frame. Header members mounted on pins adjacent the sleeves are secured to the header whereby the hinge assemblies support the door on the header of the frame assembly for movement of the door between open and closed positions.

DETAILED DESCRIPTION OF THE OVERHEAD DOOR AND FRAME ASSEMBLY

Figure 1:
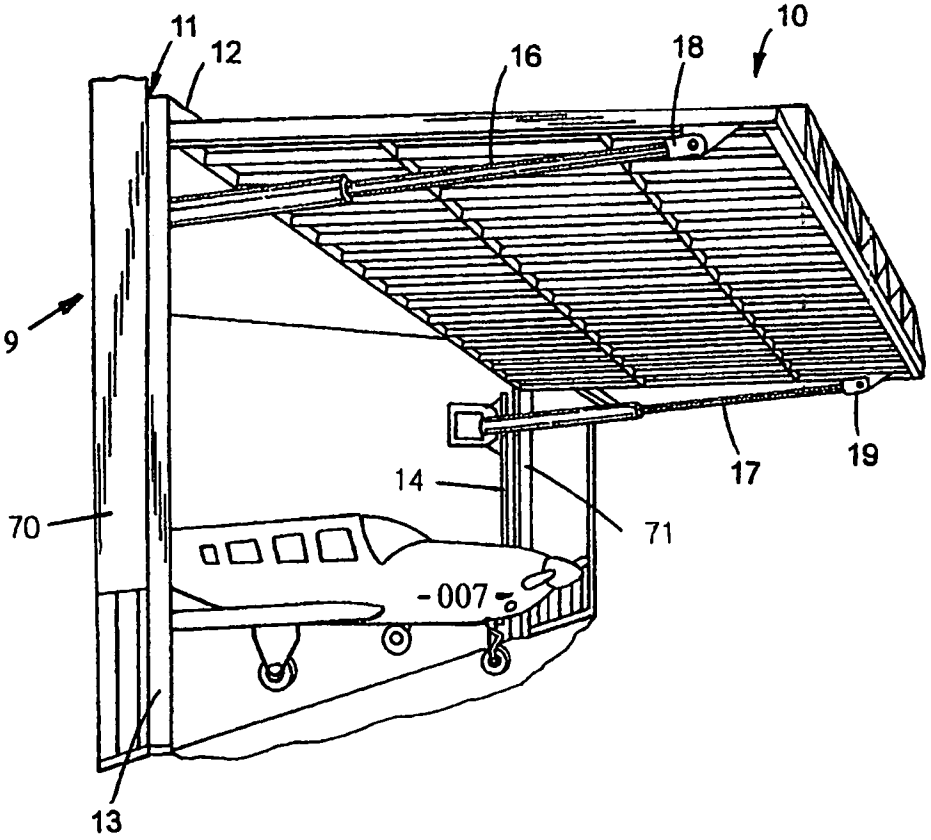
FIG. 1 is a perspective view of a building equipped with an open overhead door mounted on a frame assembly.

A building 9, shown in FIG. 1, has a doorway or opening between building walls 70 and 71 to allow a vehicle to move into and out of the interior of the building. Examples of building 9 include aviation hangers, automotive shops, farm shops, commercial buildings, warehouses and manufacturing plants. An overhead door 10 mounted on a frame assembly 11 is movable between an upright closed position and a horizontal open position. Frame assembly 11 has a horizontal header 12 attached to upright columns or legs 13 and 14. Header 12 and columns 13 and 14 are steel tubular members. Door 10 is moved between open and closed positions with linear actuators, such as hydraulic cylinders 16 and 17 or electric motor operated screws. Spherical bearing assemblies 18 and 19 connect the rod ends of hydraulic cylinders 16 and 17 to lower side members 29 and 33 of door 10. The dead ends of hydraulic cylinders 16 and 17 are pivotally connected to cylindrical supports 21 and 22 secured to columns 13 and 14 of frame assembly 11. A hydraulic fluid pump (not shown) operatively connected to opposite ends of hydraulic cylinders 16 and 17 functions to control the flow of hydraulic fluid to and from hydraulic cylinders 16 and 17 whereby hydraulic cylinders 16 and 17 selectively move door 10 between its open and closed positions. An example of a hydraulic fluid system for a hydraulically operated overhead door with hydraulic cylinders is disclosed in U.S. Pat. No. 6,883,273. A linear actuator having a motor operated screw as disclosed in U.S. Pat. No. 6,742,303.

Figure 2:
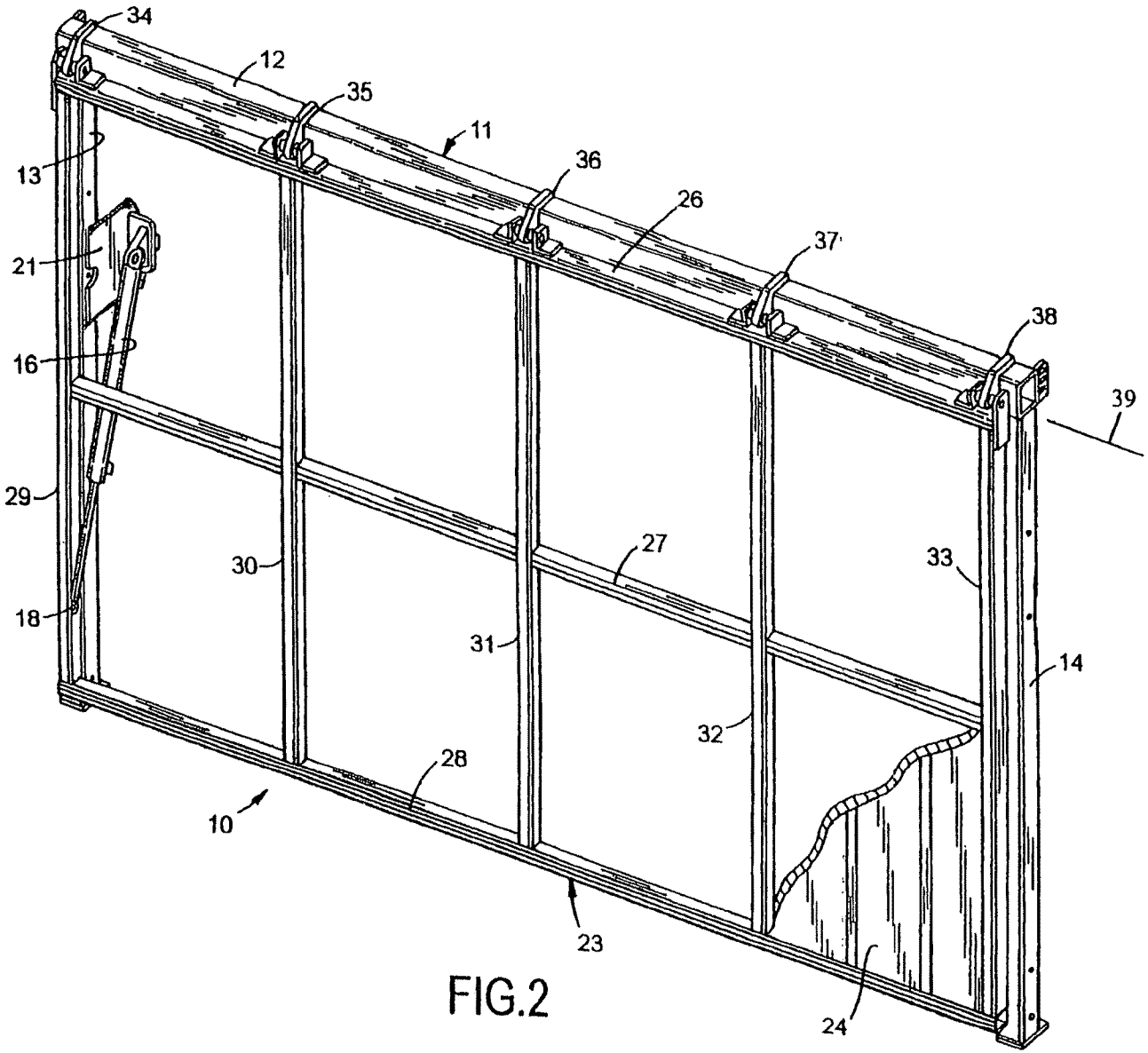
FIG. 2 is a perspective view of a closed overhead door mounted on the frame assembly.
Figure 3:
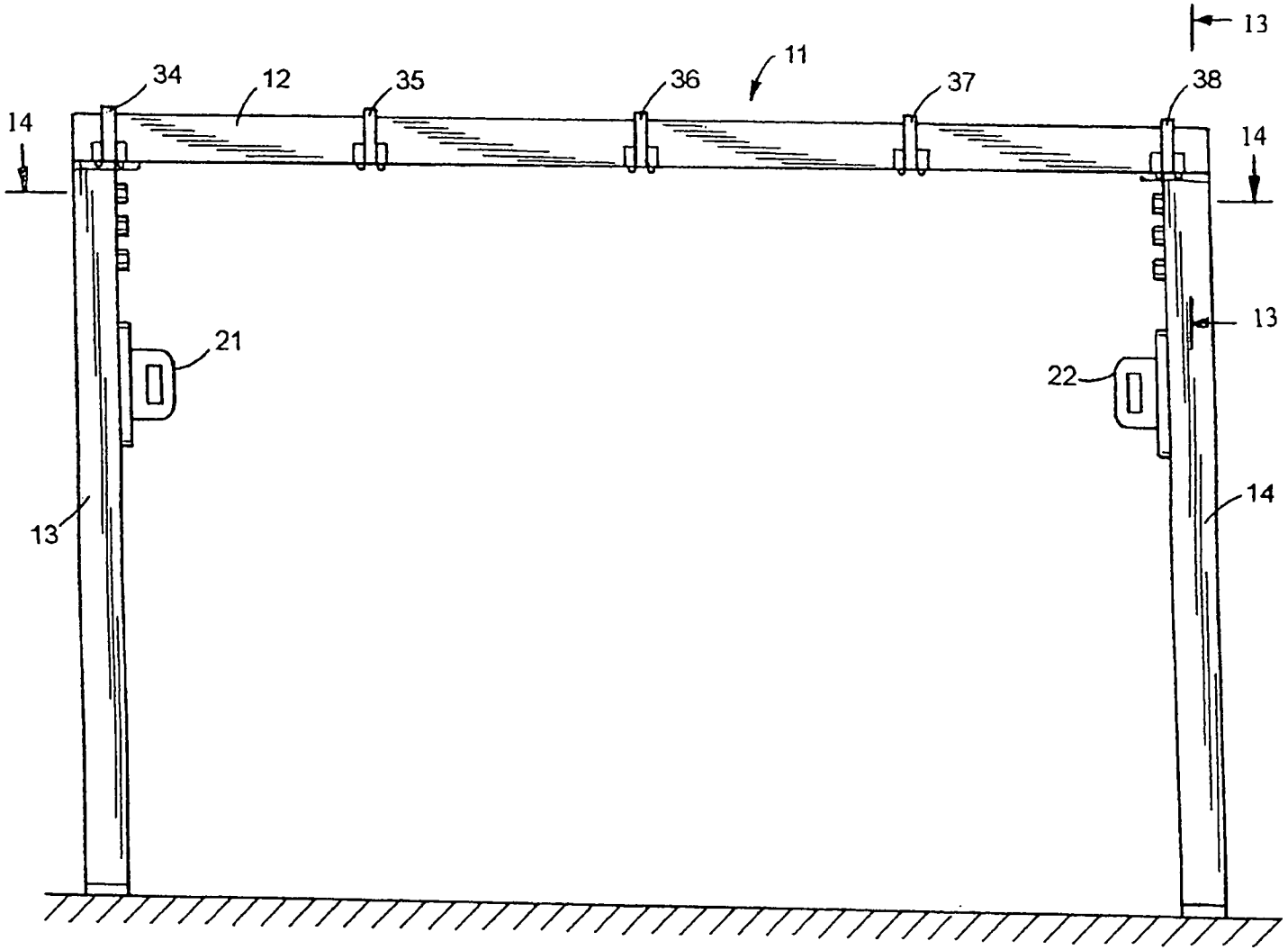
FIG. 3 is a front elevational view of the frame assembly of FIG. 2.

As shown in FIG. 2, door 10 has a rectangular door frame 23 supporting sheathing 24 and trim. Frame 23 comprises tubular steel horizontal members 26, 27 and 28 secured with welds to tubular steel upright members 29, 30, 31, 32 and 33. Sheathing 24 is attached to members 26 to 33 with fasteners or an adhesive. A plurality of hinge assemblies 34, 35, 36, 37 and 38 pivotally mount door frame 23 to header 12 of frame assembly 11 for movement about a horizontal axis 39 to a vertical closed position and a horizontal open position. Horizontal axis 39 established by hinge assemblies 34 to 38 is located laterally of the outside surface of header 12 and parallel to the length of header 12. Hinge assemblies 34 to 38 uniformly distribute the weight of door 10 on header 12 and maintain door 10 level during its opening and closing movements.

Figure 4:
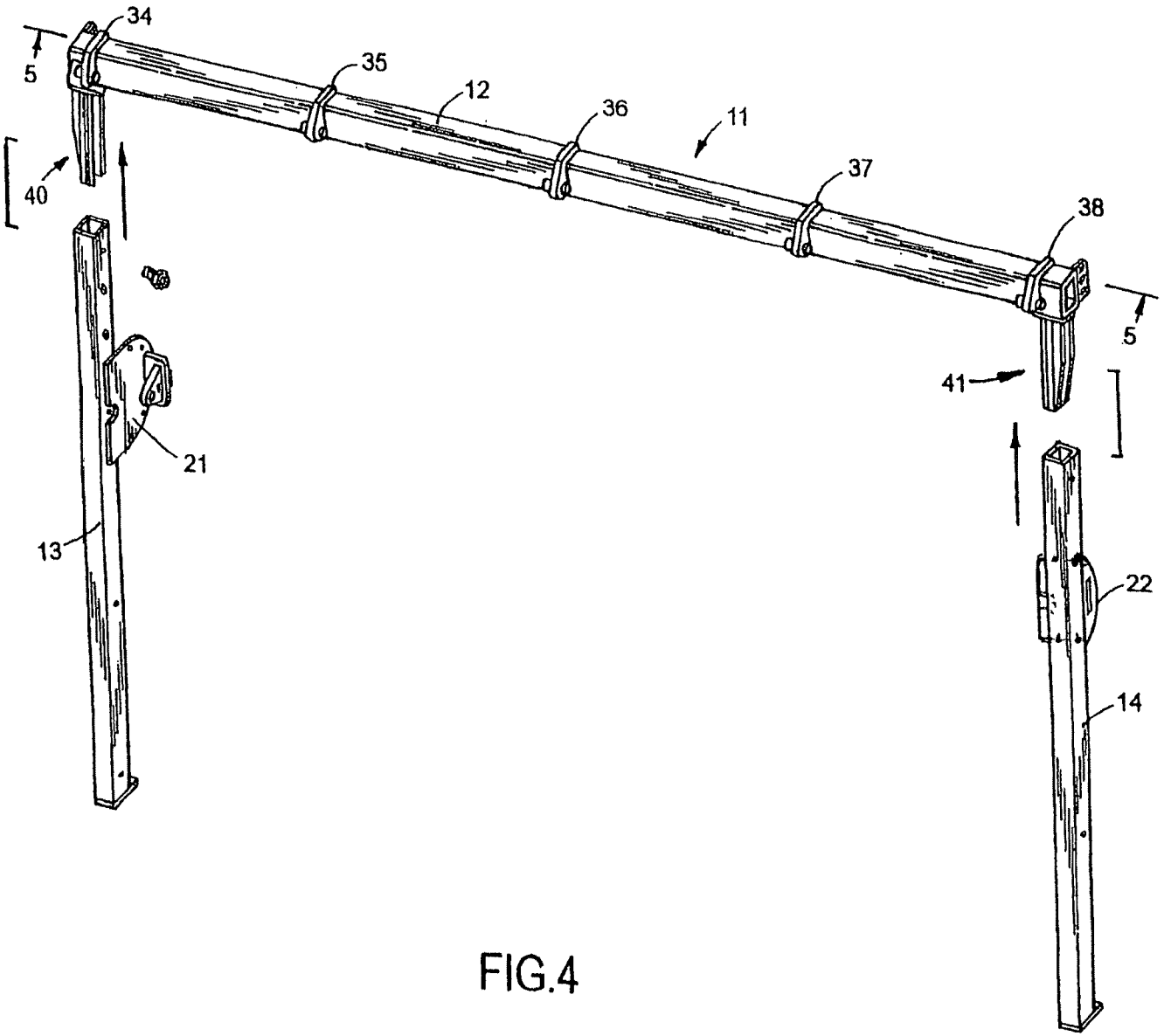
FIG. 4 is a perspective view of the frame assembly of FIG. 3 showing the frame assembly header separated from the upright side columns.
Figure 5:
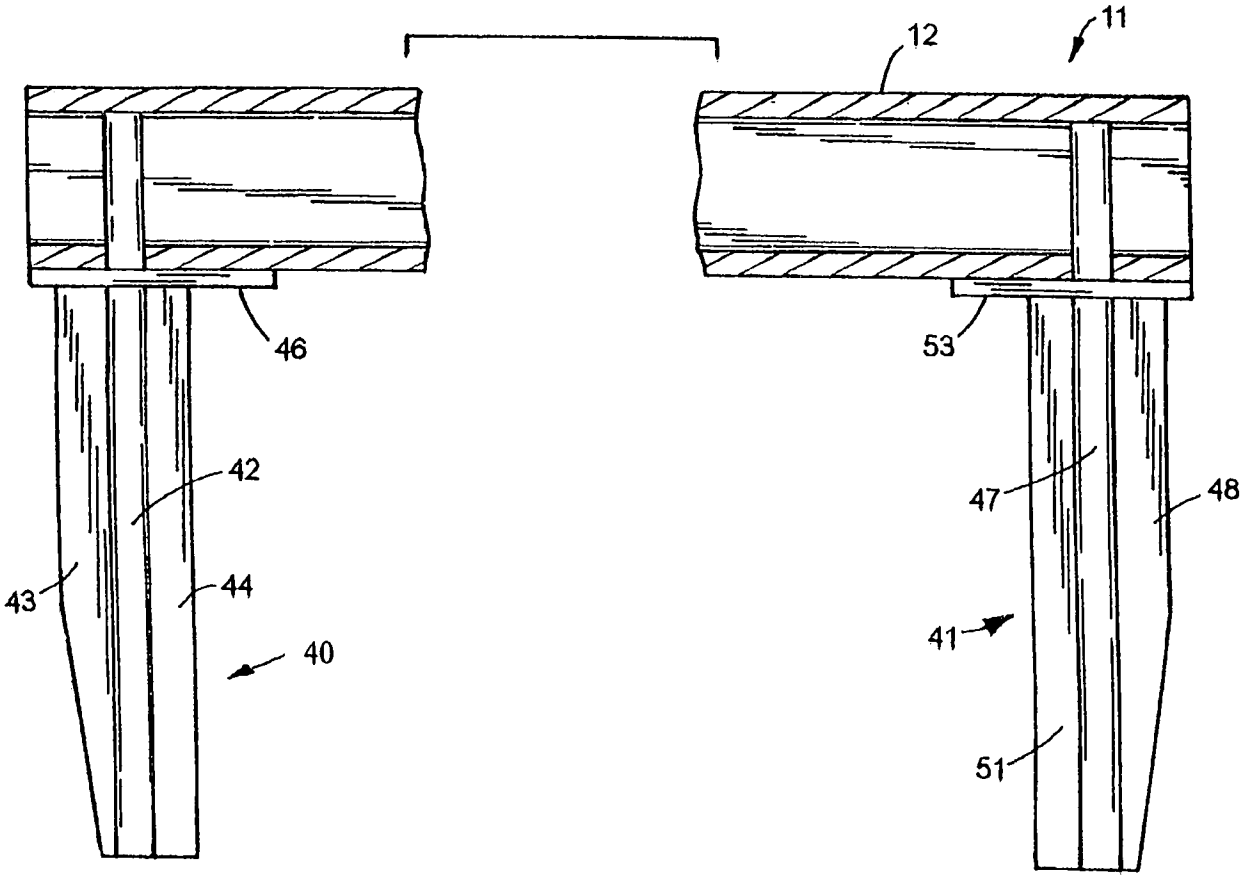
FIG. 5 is an enlarged foreshortened sectional view taken along line 5-5 of FIG. 4.
Figure 8:
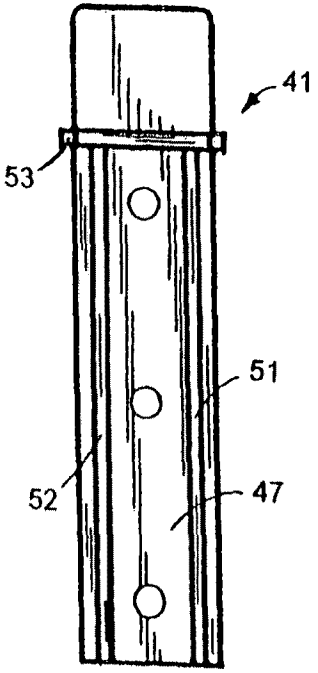
FIG. 8 is a rear elevational view of FIG. 6.
Figure 11:
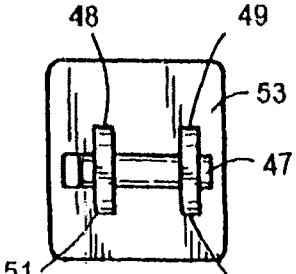
FIG. 11 is a bottom plan view of FIG. 6.
Figure 7:
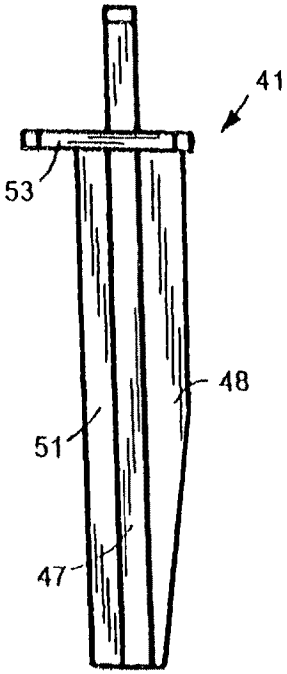
FIG. 7 is a side elevational view of the right side of FIG. 6.
Figure 10:
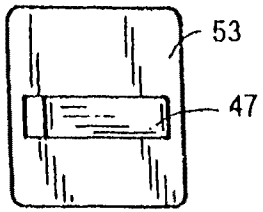
FIG. 10 is a top plan view of FIG. 6.
Figure 6:
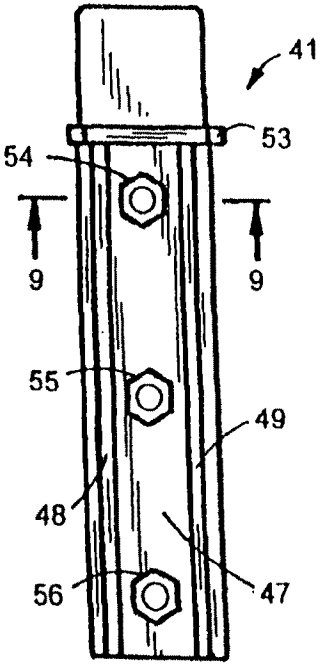
FIG. 6 is a side elevational view of a splice assembly of the frame assembly.
Figure 9:
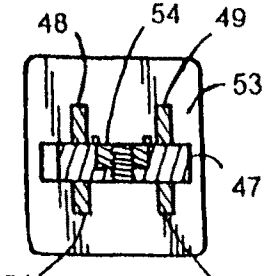
FIG. 9 is a sectional view taken along line 9-9 of FIG. 6.

Proceeding to FIGS. 4 and 5, frame assembly 11 has splice assemblies 40 and 41 attached to opposite ends of header 12. Splice assemblies 40 and 41 telescope or fit into the open upper ends of columns 13 and 14. A plurality of bolts 57, 58, 59 and 67, 69 and 82 secure columns 13 and 14 to splice assemblies 40 and 41.

Splice assembly 40 has a body 42 comprising a flat member having an upper end extended into and secured to the header 12. Body 42 extends downward from the end of header 12. A first pair of outside ribs or flanges 43 are secured to the outside of body 42. A second pair of inside ribs or flanges 44 and 45 are secured to the inside of body 42. Ribs 43, 44 and 45 are secured with welds to body 42. A horizontal plate 46 is joined to the upper ends of ribs 43 to 45. Plate 46 is located in engagement with and secured to the bottom of header 12 to retain splice assembly 40 in a downward 90 degree relationship with respect to header 12.

Splice assembly 41, shown in FIGS. 5 to 11, has a body 47 having an upper end extended into and secured to the header 12. A first pair of ribs or flanges 48 and 49 are secured to the inside surface of body 47. A second pair of ribs or flanges 51 and 52 are secured to the outside surface of body 47. Ribs 48, 49, 51 and 52 reinforce opposite sides of body 47 and space body 47 from the side walls of column 14. The inside surface of body 47 has hexagonal cavities accommodating retainers or nuts 54, 55 and 56. Welds secure nuts 54, 55, and 56 to body 47. Other types of threaded members can be secured to body 47 for accommodating bolts 57, 58 and 59. Body 42 has a plurality of retainers or nuts 68, 81 and 83 similar to nuts 54, 55 and 56. A horizontal plate 53 is secured to the upper ends of ribs 48, 49, 51 and 52. Plate 53 is located in engagement with and secured to the bottom of header 12 to retain splice assembly 41 in a downward 90 degree relationships with respect to header 12.

Splice assembly 40 is secured to column 13 with bolts 67, 69 and 82. Nuts 68, 81 and 83 mounted on body 42 accommodate bolts 67, 69 and 82 extended through holes in column 13. Bolts 67, 69 and 82 are turned tight to retain the outer ends of ribs 44 and 45 in engagement with the inside of wall 13A of column 13. The outer wall 13C of column 13 and the adjacent end of header 12 is located in vertical alignment with the second outer end of header 12. Wall 13C has an outer surface located in the same or common vertical plane as the second end of header 12. A bolt 84 threaded through a nut 85 secured to column 13 engages a side of body 42. Bolt 84 is turned tight to hold body 42 in firm contact with the inside of wall 13B of column 13. A plurality of bolts contact body 42 to prevent column 13 from moving forward and rearward relative to splice assembly 40.

Returning to FIG. 2, a plurality of hinge assemblies 34 to 38 pivotally mount door 10 on header 12. Hinge assemblies 34 to 38 have a common horizontal axis 39 allowing hydraulic cylinders 16 and 17 to swing door 10 from an upright closed position to a generally horizontal open position. The open horizontal position of door 10 is shown in FIG. 1. Hinge assemblies 34 to 38 are identical in structure and function. The following description of hinge assembly 35 is applicable to hinge assemblies 34 and 36 to 38 and additional hinge assemblies used to pivotally mount door 10 on header 12.

Figure 12:
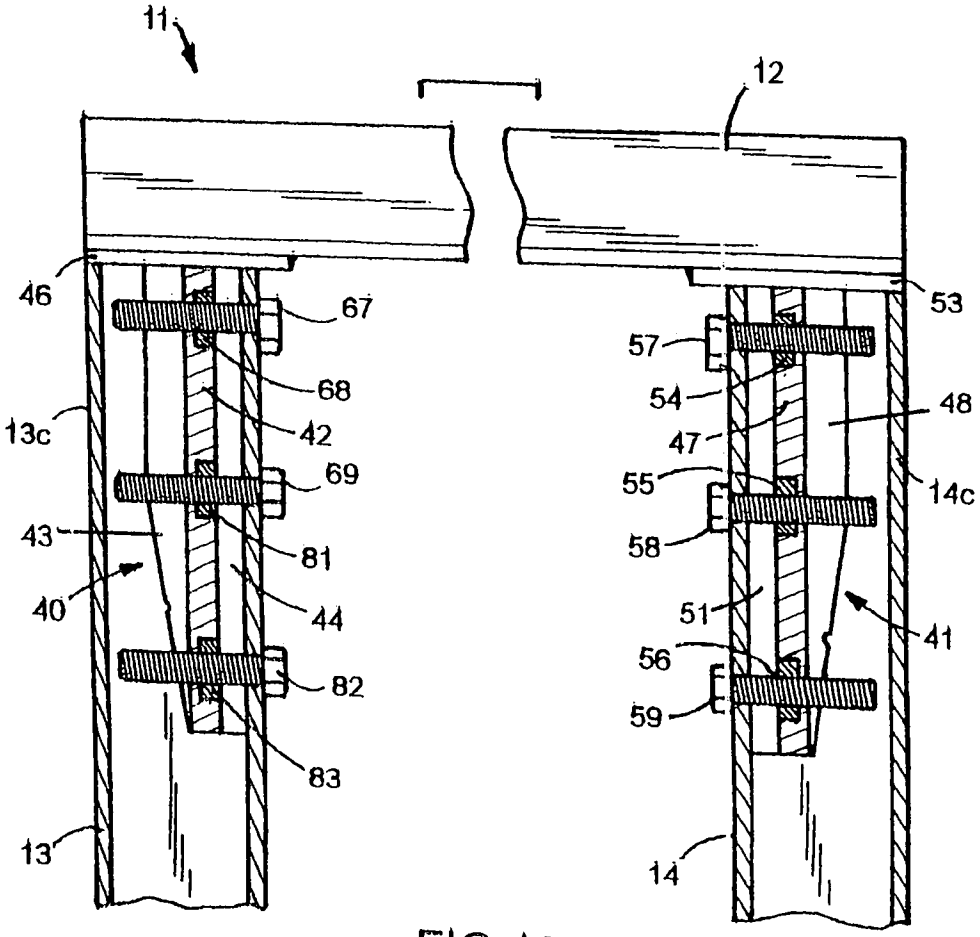
FIG. 12 is an enlarged foreshortened front elevational view, partly sectioned, of the frame assembly of FIG. 3.
Figure 14:
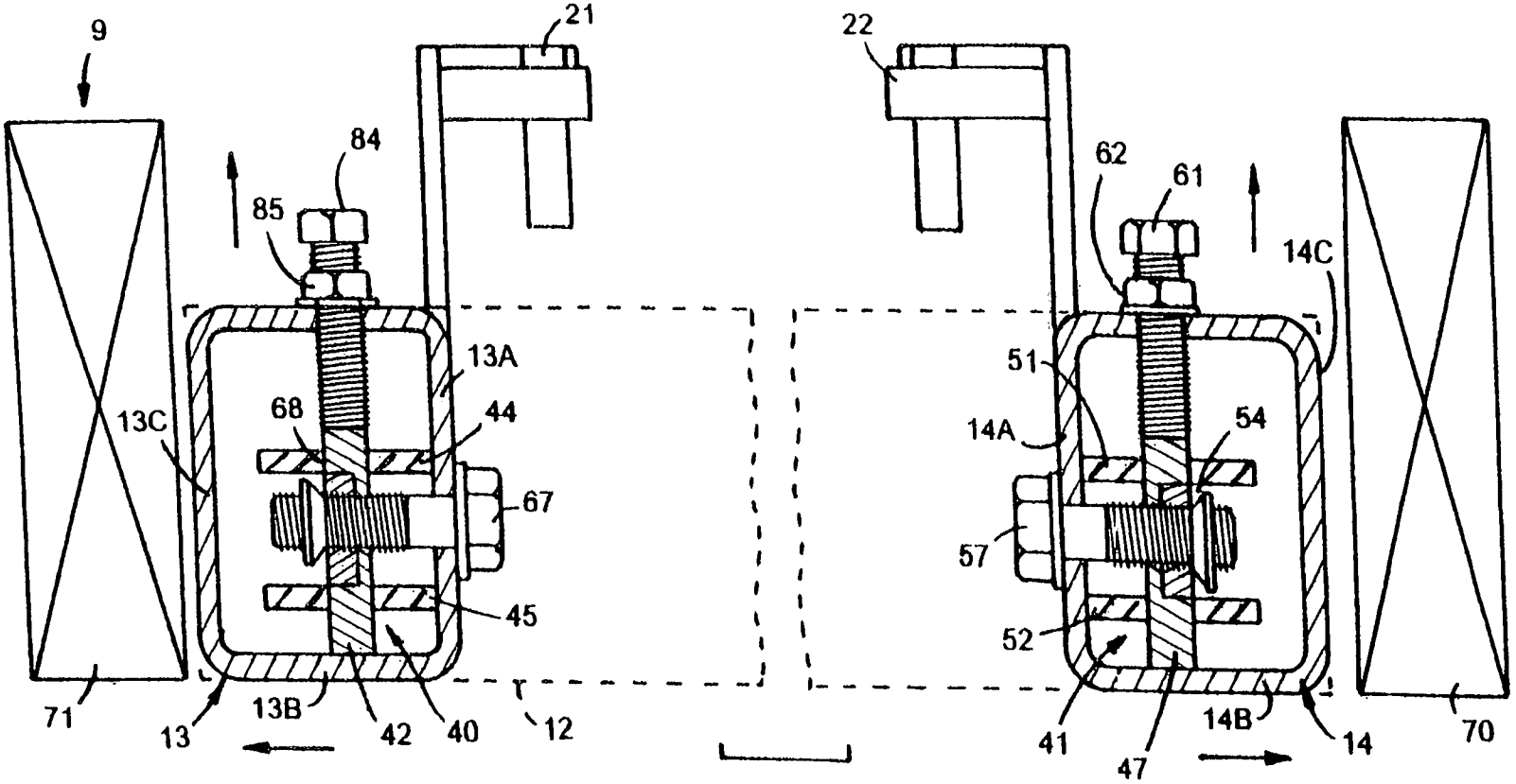
FIG. 14 is an enlarged foreshortened sectional view taken along line 14-14 of FIG. 3.

Proceeding to FIGS. 12 and 14, columns 13 and 14 are inserted into splice assemblies 40 and 41 secured to opposite ends of header 12. A plurality of bolts 57, 58 and 59 extended through holes in column 14 are threaded into nuts 54, 55 and 56. Bolts 57, 58 and 59 are turned tight to secure column 14 to splice assembly 41 and move inner wall 14A of column 14 into firm engagement with ribs 48 and 49. Outer wall 14C of column 14 is located in vertical alignment with the first outer end of header 12. The outer surface of wall 14C of column 14 is located in the same or common vertical plane as the first end of header 12. The first end of header 12 and column 14 are located in close relationship with the adjacent surface of building wall 70.

Figure 13:
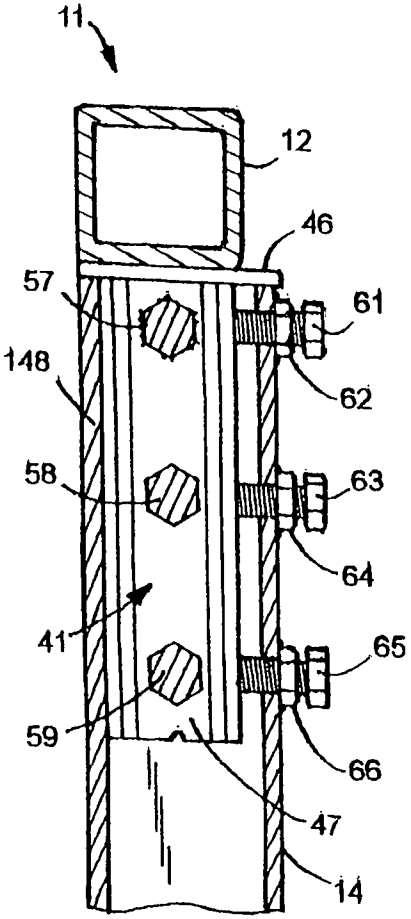
FIG. 13 is an enlarged sectional view taken along line 13-13 of FIG. 3.

As shown in FIG. 13, bolts 61, 63 and 65 threaded through nuts 62, 64 and 66 engage a side of body 47. Nuts 62, 64 and 66 are secured by welds adjacent holes in column 14. Bolts 61, 63 and 65 are turned to force body 47 into surface engagement with the inside of wall 14B of column 14. The outside surface of wall 14B of column 14 is vertically aligned with the outside front surface of header 12. The outside surface of wall 14B of column 14 and the outside front surface of header 12 are located in the same or common vertical plane.

Splice assembly 41 secured to column 14 with bolts 57, 58 and 59 and 61, 63 and 65 retains column 14 in a vertical position relative to header 12. Column 14 is prevented from moving laterally and vertically relative to header 12. Bolts 57, 58 and 59 and 61, 63 and 65 also permit adjustment of column 14 in two directions relative to the end of header 12.

Figure 15:
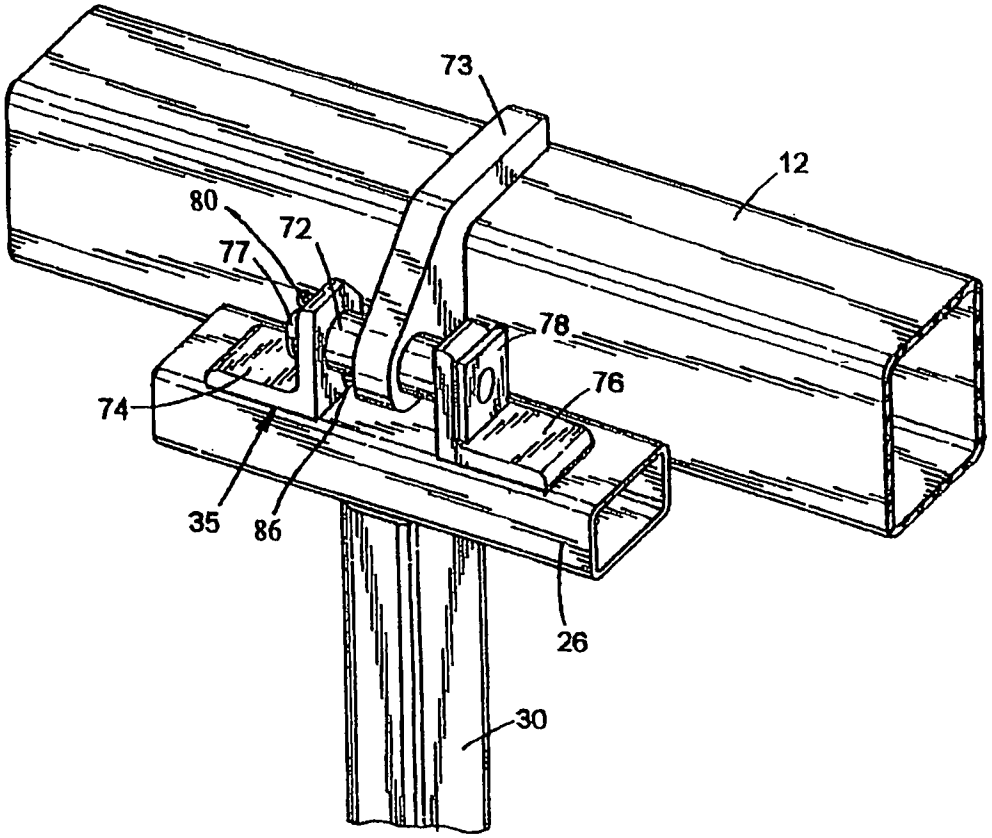
FIG. 15 is a perspective view of a hinge assembly pivotally mounting the door to the frame assembly header.

Hinge assembly 35, shown in FIG. 15, has a tubular member or sleeve 72 secured to an arm 73. Arm 73 extends across the top of header 12. Welds secure arm 73 to header 12. Left and right angle supports 74 and 76 located adjacent opposite ends of sleeve 72 accommodate a pin 77. Pin 77 extended horizontally through sleeve 72 pivotally mounts sleeve 72 and arm 73 on pin 77. Supports 74 and 76 are welded to the horizontal top door frame member 26. A square head 78 secured to an end of pin 77 prevents rotation of pin 77 relative to supports 74 and 76. Head 78 and cotter key 80 on opposite ends of pin 77 limit axial movement of pin 77 relative to supports 74 and 76. Grease zerks 86 mounted on sleeve 72 are used to apply grease to the inside cylindrical surface of sleeve 72.

The foregoing drawing and description of the frame assembly and hinge for an overhead door is one embodiment of the invention. Persons skilled in the art of overhead doors can make changes and modifications in structures and materials of the door, frame assembly and hinge assemblies without departing from the door, frame assembly and hinge assemblies defined in the claims.

The invention claimed is:

1. A method of connecting a frame having a header and a splice assembly to a tubular column having a first wall, a second wall located perpendicular to the first wall and an open end the splice assembly having a body, said body having a first edge, a second edge opposite the first edge, a side wall extending between the first edge and the second edge, and a plurality of ribs joined to the side wall of the body, the plurality of ribs having elongated outer ends spaced away from the side wall of the body, comprising the steps of:

securing the body and the plurality of ribs of the splice assembly to the header, locating the body and the plurality of ribs within the open end of the tubular column and positioning the plurality of ribs adjacent the first wall of the tubular column, holding the elongated outer ends of the plurality of ribs in engagement with the first wall of the tubular column using at least one first fastener that engages and applies a first force to the side wall of the body to urge the plurality of ribs toward the first wall of the tubular column, and holding the first edge of the body in engagement with the second wall of the tubular column using at least one second fastener that engages and applies a second force to the second edge of the body to urge the second edge of the body toward the second wall of the tubular column.

2. A method of connecting a frame having a header and a splice assembly to a tubular column having a first wall, a second wall located perpendicular to the first wall and an open end the splice assembly having a body having a first elongated end, a second elongated end opposite the first elongated end, a side wall extending between the first elongated end and the second elongated end of the body, a first rib secured to the side wall of the body, said first rib having an elongated first outer end surface spaced away from the side wall, and a second rib secured to the side wall of the body, said second rib being laterally spaced from and parallel to the first rib, said second rib having an elongated second outer end surface spaced away from the side wall of the body, comprising the steps of:

locating the body of the splice assembly perpendicular to the header, securing the body, the first rib and the second rib of the splice assembly to the header to maintain the body perpendicular to the header, locating the body, the first rib and the second rib within the open end of the tubular column and positioning the elongated first and second outer end surfaces of the first and second ribs adjacent the first wall of the tubular column, holding both the elongated first outer end surface of the first rib and the elongated second outer end surface of the second rib in engagement with the first wall of the tubular column using at least one first fastener that engages and applies a first force on the side wall of the body between the first rib and the second rib to urge the ribs toward the first wall of the tubular column, and holding the first elongated end of the body in engagement with the second wall of the tubular column using at least one second fastener that engages and applies a second force to the second elongated end of the body to urge the first elongated end of the body toward the second wall of the tubular column.

3. A method of connecting a frame having a header and a splice assembly to a column having a first wall a second wall located perpendicular to the first wall and an open end, the splice assembly having a body having an elongated first end, an elongated second end opposite the elongated first end, a side wall located between the elongated first end and the elongated second end, a first rib secured to the side wall of the body between the elongated first and second ends of the body, the first rib having an elongated first outer end surface spaced away from the side wall of the body, and a second rib secured to the side wall of the body between the elongated first and second ends of the body, the second rib having an elongated second outer end surface spaced away from the side wall of the body, said second rib being laterally spaced from and parallel to the first rib, comprising the steps of:

locating the body, the first rib and the second rib of the splice assembly perpendicular to the header, securing the body, the first rib and the second rib to the header to maintain the body, the first rib and the second rib perpendicular to the header, placing the body, the first rib and the second rib in the open end of the column, holding both the elongated first outer end surface of the first rib and the elongated second outer end surface of the second rib in engagement with the first wall of the column using a plurality of first fasteners that engage and apply a first force on the side wall of the body between the first rib and the second rib to urge the outer end surfaces of the ribs toward the first wall of the column, and maintaining the elongated first end of the body in a fixed location relative to the second wall of the column by holding the elongated first end of the body into engagement with the second wall of the column using a plurality of second fasteners that engage and apply a second force to the elongated second end of the body toward the second wall of the column.

* * * * *